US008333218B2

(12) United States Patent
Walsh et al.

(10) Patent No.: US 8,333,218 B2
(45) Date of Patent: Dec. 18, 2012

(54) PROPORTIONAL PRESSURE CONTROLLER

(75) Inventors: Timothy F. Walsh, Clarkston, MI (US); Kevin C. Williams, Wixom, MI (US)

(73) Assignee: MAC Valves, Inc., Wixom, MI (US)

( * ) Notice: Subject to any disclaimer, the term of this patent is extended or adjusted under 35 U.S.C. 154(b) by 429 days.

(21) Appl. No.: 12/694,703

(22) Filed: Jan. 27, 2010

(65) Prior Publication Data

US 2011/0179946 A1 Jul. 28, 2011

(51) Int. Cl.
*F15B 13/06* (2006.01)

(52) U.S. Cl. ..... 137/596.16; 137/596.18

(58) Field of Classification Search ..... 137/596.14, 137/596.16, 596.17, 596.18
See application file for complete search history.

(56) References Cited

U.S. PATENT DOCUMENTS 4,067,357 A * 1/1978 Ruchser ..... 137/596.16
4,111,226 A * 9/1978 Cameron ..... 137/269
4,754,693 A * 7/1988 Teltscher ..... 91/464
4,773,301 A * 9/1988 Shimamura et al. ..... 303/114.3
4,883,091 A 11/1989 Weiler et al.
5,361,679 A 11/1994 Foster
5,454,399 A * 10/1995 Kazakis et al. ..... 137/596.16
6,082,406 A 7/2000 Williamson, Jr. et al.
6,186,172 B1 2/2001 Yoshida
6,192,928 B1 2/2001 Knoell et al.
6,196,247 B1 3/2001 Knoell et al.
6,871,574 B2 3/2005 Barber
2002/0197173 A1 12/2002 Ogawa
2004/0237768 A1 12/2004 Barber

* cited by examiner

*Primary Examiner* — Craig Schneider
(74) *Attorney, Agent, or Firm* — Harness, Dickey & Pierce, P.L.C.

(57) ABSTRACT

A proportional pressure controller includes a body having inlet, outlet, and exhaust ports. A fill valve communicates with pressurized fluid in the inlet port. A dump valve communicates with pressurized fluid from the fill valve. An inlet poppet valve opens by pressurized fluid through the fill valve. An exhaust poppet valve when closed isolates pressurized fluid from the exhaust port. An outlet flow passage communicates with pressurized fluid when the inlet poppet valve is open, and communicates with the outlet port and an exhaust/outlet common passage. A fill inlet communicates between the inlet passage and fill valve, and is isolated from the outlet flow passage, exhaust/outlet common passage, and outlet and exhaust ports in all operating conditions of the controller.

33 Claims, 9 Drawing Sheets

PROPORTIONAL PRESSURE CONTROLLER

FIELD

The present disclosure relates to proportional pressure controllers adapted for use in pneumatic systems.

BACKGROUND

This section provides background information related to the present disclosure which is not necessarily prior art.

Proportional pressure controllers often include main internal valves which are moved to permit a pressurized fluid to be discharged to an actuation device while controlling the operating pressure of the fluid at the actuation device. The main valves are commonly repositioned using solenoids operators. This configuration increases weight and expense of the controller, and requires significant electrical current to reposition the main valves.

Known proportional pressure controllers are also often susceptible to system pressure undershoot or overshoot, wherein due to the mass and operating time of the main valves, the signal to reduce or stop pressurized fluid flow to the actuation device may occur too soon or too late to avoid either not reaching or exceeding the desired operating pressure. When this occurs, the control system operating the solenoid actuators begins a rapid opening and closing sequence as the controller "hunts" for the desired operating pressure. This rapid operation is known as "motor-boating" and further increases controller wear and cost of operation.

SUMMARY

This section provides a general summary of the disclosure, and is not a comprehensive disclosure of its full scope or all of its features.

According to several embodiments, a proportional pressure controller includes: a controller assembly including a body having inlet, outlet, and exhaust ports; a fill valve is in communication with a pressurized fluid in the inlet port; a dump valve is in communication with the pressurized fluid in a discharge passage of the fill valve; and an inlet poppet valve and an exhaust poppet valve. An outlet flow passage is in communication with the pressurized fluid when the inlet poppet valve is moved to an inlet poppet valve open position. The outlet flow passage communicates with the outlet port and an exhaust/outlet common passage normally isolated from the exhaust port when the exhaust poppet valve is in an exhaust poppet valve closed position. A fill inlet passage provides fluid communication between the inlet passage and the fill valve, and is isolated from each of the outlet flow passage, the exhaust/outlet common passage, and the outlet and exhaust ports in all operating conditions of the controller. The fill inlet passage communicates with the inlet passage and being continuously pressurized by the pressurized fluid in the inlet passage. A pressure sensor is positioned in the discharge passage to isolate the pressure sensor from fluid in the outlet port.

According to additional embodiments, a proportional pressure controller includes a controller body including: inlet, outlet, and exhaust ports; an inlet passage and an outlet passage, the inlet passage communicating a flow of pressurized fluid from the inlet port to the outlet passage, and the outlet passage communicating the flow of pressurized fluid from the inlet passage to the outlet port; and a piston slidably disposed in the controller body. A receiving passage is isolated from any of the inlet and outlet passages and the inlet, outlet, and exhaust ports in each of an open, a closed, and an exhaust operating condition of the controller. The receiving passage fluidly connects to a chamber upstream of the piston and to an exhaust valve pressurization chamber. A slidably disposed inlet poppet valve is adapted to isolate the outlet passage from the inlet passage in an inlet poppet valve closed position. The inlet poppet valve is normally biased to the inlet poppet valve closed position. A slidably disposed exhaust poppet valve is normally held in an exhaust poppet valve closed position by the pressurized fluid in the exhaust valve pressurization chamber. The exhaust poppet valve adapted to isolate outlet passage from the exhaust port in the exhaust poppet valve closed position.

According to other embodiments, a proportional pressure controller includes a controller assembly having open, closed/pressure achieved, and exhaust controller positions. The controller assembly also includes: a body having inlet, outlet, and exhaust ports and an exhaust/outlet common passage; a fill valve in communication with a pressurized fluid in the inlet port; a dump valve in communication with the pressurized fluid in a discharge passage of the fill valve; and a piston slidably disposed in the body in communication with a piston pressurization chamber and moved in response to the pressurized fluid entering the piston pressurization chamber. An inlet poppet valve contacting the piston is slidably disposed in the body. The inlet poppet valve is normally biased to an inlet poppet valve closed position in the closed controller position. The inlet poppet valve is movable by displacement of the piston to an inlet poppet valve open position defining the open controller position. An exhaust poppet valve is slidably disposed in the body and held in an exhaust poppet valve closed position by the fluid pressure directed through the fill valve acting on an end face of the exhaust poppet valve. The fluid pressure creates a greater force than a force due to pressure in the exhaust/outlet common passage of the body acting on an opposite face of the exhaust poppet valve. The exhaust poppet valve isolates the pressurized fluid from the exhaust port when in the closed position.

According to further embodiments, a proportional pressure controller includes a controller assembly having open, closed/pressure achieved, and exhaust controller conditions. The controller assembly also includes: a body having inlet, outlet, and exhaust ports, and an exhaust/outlet common passage; and a valve system adapted to control flow of a pressurized fluid. An inlet poppet valve is slidably disposed in the body and normally biased to an inlet poppet valve closed position defining the controller closed condition. The inlet poppet valve is movable to an inlet poppet valve open position defining the controller open condition by the pressurized fluid directed through the valve system. An exhaust poppet valve is slidably disposed in the body and held in an exhaust poppet valve closed position by the fluid pressure directed through the valve system into an exhaust valve pressurization chamber. An outlet flow passage is in communication with the pressurized fluid from the inlet port when the inlet poppet valve is moved to the inlet poppet valve open position. The outlet flow passage communicates with the outlet port and the exhaust/outlet common passage is normally isolated from the exhaust port when the exhaust poppet valve is in the exhaust poppet valve closed position. A fill inlet passage provides fluid communication between the inlet passage and the valve system. The fill inlet passage is isolated from each of the outlet flow passage, the exhaust/outlet common passage, and the outlet and exhaust ports in all the operating conditions of the controller. The fill inlet passage communicates with and is continuously pressurized by the pressurized fluid in the inlet passage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 2:
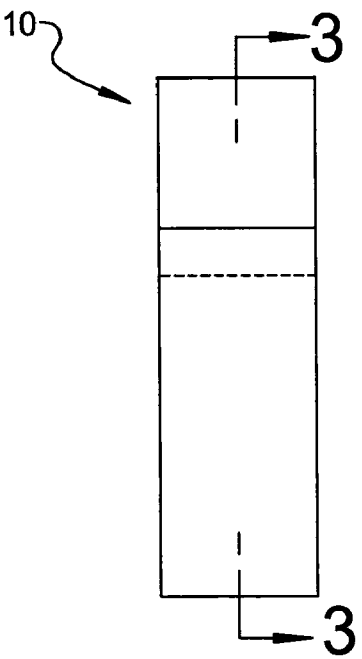
FIG. 2 is a side elevational view of the proportional pressure controller of FIG. 1.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
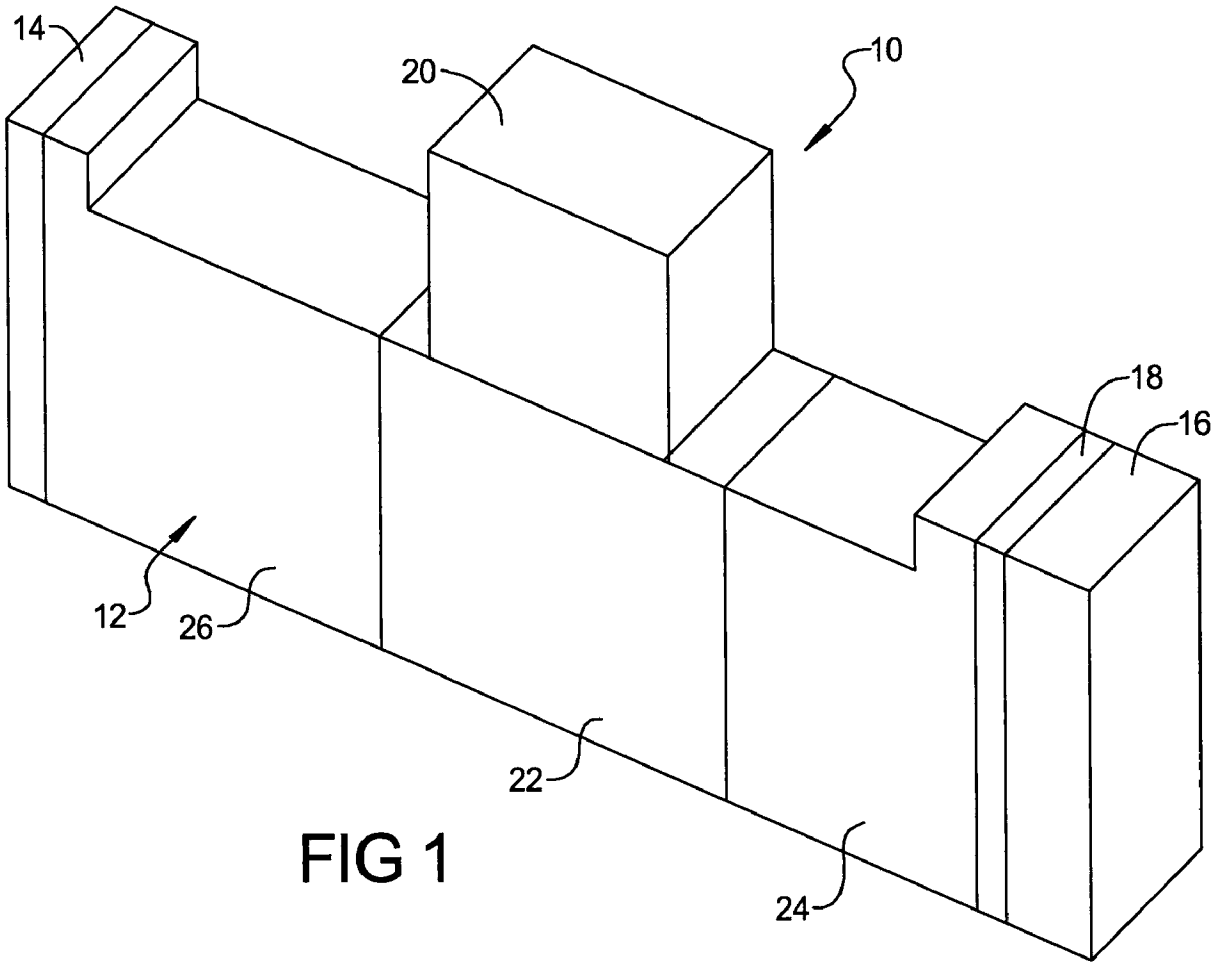
FIG. 1 is a left front perspective view of a proportional pressure controller of the present disclosure.

Referring to FIG. 1, a proportional pressure controller 10 includes a body 12 having a first end cap 14 at a first end and a second end cap 16 at an opposite and. First and second end caps 14, 16 can be releasably fastened or fixedly connected to body 12. A spacer member 18 can also be included with body 12 whose purpose will be discussed in reference to FIG. 3. A controller operator 20 can be connected such as by fastening or fixed connection to a central body portion 22. Body 12 can further include an inlet body portion 24 connected between central body portion 22 and spacer member 18, with spacer member 18 positioned between inlet body portion 24 and second end cap 16. Body 12 can further include an exhaust body portion 26 positioned between central body portion 22 and first end cap 14.

Referring to FIG. 2, proportional pressure controller 10 can be provided in the form of a generally rectangular-shaped block body such that multiple ones of the proportional pressure controllers 10 can be arranged in a side-by-side configuration. This geometry also promotes use of the proportional pressure controller 10 in a manifold configuration.

Figure 3:
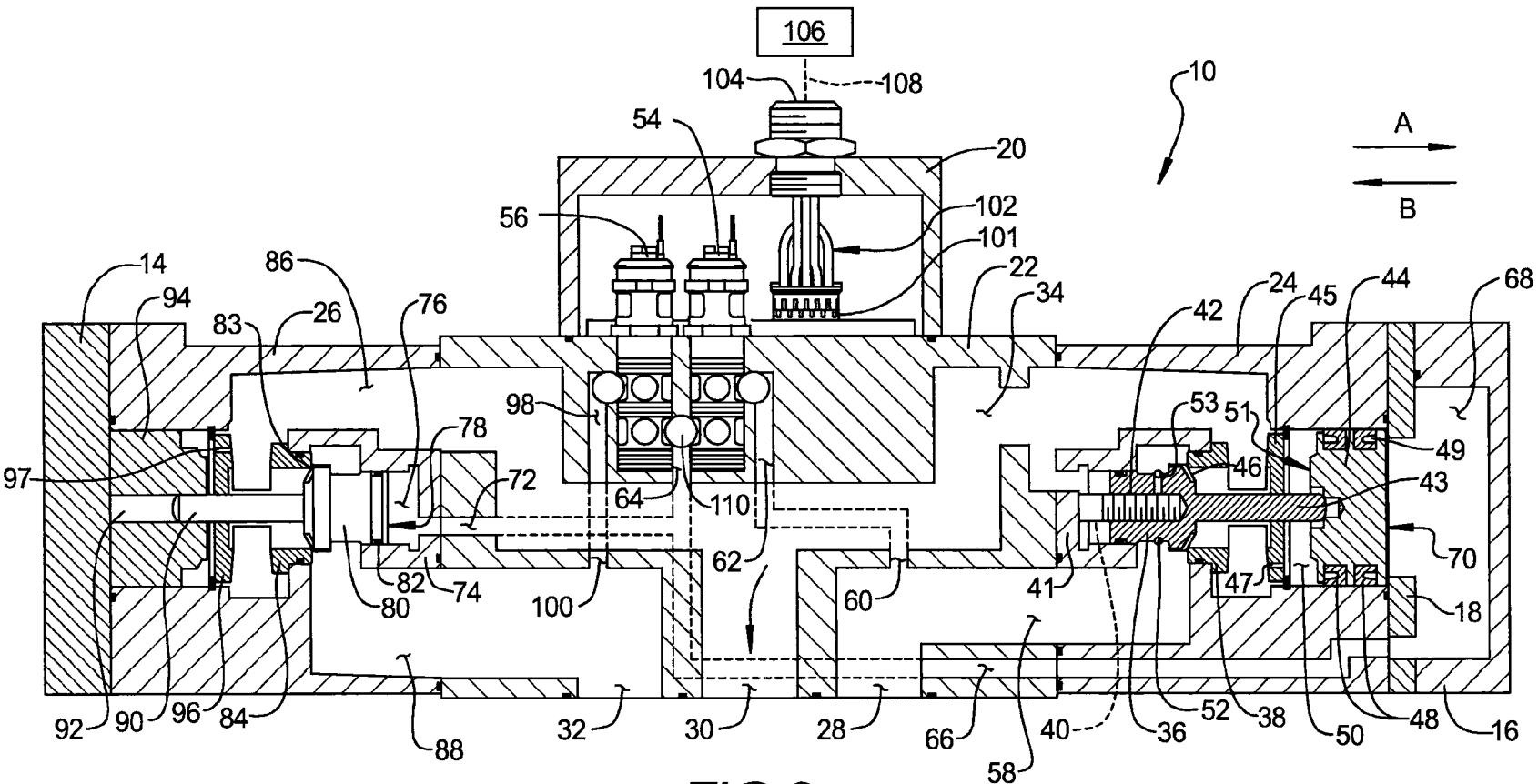
FIG. 3 is a cross sectional front elevational view taken at section 3 of FIG. 2.

Referring to FIG. 3, according to several embodiments, the inlet and exhaust body portions 24, 26 are releasably and sealingly connected to the central body portion 22. Proportional pressure controller 10 can include each of an inlet port 28, an outlet port 30, and an exhaust port 32 each created in the central body portion 22. A pressurized fluid such as pressurized air can be discharged from proportional pressure controller 10 via outlet port 30 through an outlet flow passage 34. Flow to the outlet flow passage 34 can be isolated using an inlet poppet valve 36. Inlet poppet valve 36 is normally seated against an inlet valve seat 38 and held in the seated position shown with assist by the force of a biasing member 40 such as a compression spring, defining a controller closed condition wherein no fluid flow is discharged through either outlet or exhaust port 30, 32. The biasing member 40 can be held in position by contact with an end wall 41 of inlet body portion 24, and oppositely by being partially received in a valve cavity 42 of inlet poppet valve 36. Inlet poppet valve 36 can axially slide in each of an inlet valve closing direction "A" extending biasing member 40 and an opposite inlet valve opening direction "B" compressing biasing member 40.

Oppositely directed from valve cavity 42 is an inlet valve stem 43 integrally and axially extending from inlet poppet valve 36 and coaxially aligned with biasing member 40. A free end of inlet valve stem 43 contacts a piston 44. Inlet valve stem 43 is slidably disposed through a first boundary wall 45 before contacting piston 44 to help control an axial alignment of inlet poppet valve 36 to promote a perimeter seal of a poppet seat ring 46 with inlet valve seat 38 in the closed position. Pressurized fluid can free-flow through first boundary wall 45 via at least one hole 47 and/or through the bore that permits passage of inlet valve stem 43. A size and quantity of the at least one hole 47 controls the time required for pressure in outlet flow passage 34 to act on piston 44 (on the left side as viewed in FIG. 3) and therefore the speed of piston movement. The pressure acting through the at least one hole 47 creates a pressure biasing force acting to move piston 44 toward the closed position. Piston 44 can be provided with at least one and according to several embodiments a plurality of resilient U-cup seals 48 which are individually received in individual seal grooves 49 created about a perimeter of piston 44. U-cup seals 48 provide a fluid pressure seal about piston 44 as piston 44 axially slides within a cylinder cavity 50.

Piston 44 moves coaxially with the inlet poppet valve 36 in inlet valve closing direction "A" or the inlet valve opening direction "B". First boundary wall 45 defines a first boundary (a non-pressure boundary) and piston 44 defines a second boundary (a pressure boundary) of a cylinder cavity 50 which slidingly receives piston 44. Piston 44 can move in the inlet valve opening direction "B" until an end 51 of piston 44 contacts first boundary wall 45 (at a right hand facing side of first boundary wall 45 as seen in FIG. 3) with first boundary wall 45 being fixed in position. Piston 44 is retained within cylinder cavity 50 by contact with first boundary wall 45 by the previously described pressure biasing force created by pressurized fluid freely flowing through the holes 47. Piston 44 is also retained within cylinder cavity 50 by contact at an opposite end of cylinder cavity 50 with portions of spacer member 18 which extend radially past a cylindrical wall of cylinder cavity 50 as shown.

An elastic seal member 52 such as an O-ring can be positioned within a slot or circumferential groove 53 created externally about a perimeter of inlet poppet valve 36. Elastic seal member 52 provides a relief capacity for pressurized fluid in valve cavity 42 which will be further described in reference to FIG. 5.

Proportional pressure controller 10 can be operated using each of an inlet or fill valve 54 and a dump valve 56 which can be releasably connected to central body portion 22 within controller operator 20. Pressurized fluid such as pressurized air received in inlet port 28 is commonly filtered or purified. Fluid that can back-flow into proportional pressure controller 10 via outlet port 30 and outlet flow passage 34 is potentially contaminated fluid. According to several embodiments, the fill and dump valves 54, 56 are isolated from the potentially contaminated fluid such that only the filtered air or fluid received via inlet port 28 flows through either fill valve 54 or dump valve 56. An inlet flow passage 58 communicates between inlet port 28 and outlet flow passage 34 and is isolated from outlet flow passage 34 by inlet poppet valve 36 which can be normally closed. An air supply port 60 communicates with inlet flow passage 58 and via a fill inlet passage 62 which is isolated from outlet flow passage 34, provides pressurized fluid or air to fill valve 54. A valve discharge passage 64 provides a path for air flowing through fill valve 54 to be directed to an inlet of dump valve 56 and a plurality of different passages.

One of these passages includes a piston pressurization passage 66 which directs air or fluid from valve discharge passage 64 to a piston pressurization chamber 68 created in second end cap 16. Pressurized air or fluid in piston pressurization chamber 68 generates a force acting on a piston end face 70 of piston 44. A surface area of piston end face 70 is larger than a surface area of inlet poppet valve 36 in contact with inlet valve seat 38, therefore, when fill valve 54 opens or continues to open further, the net force created by the pressurized fluid acting on piston end face 70 causes piston 44 to initially move or move further in the inlet valve opening direction "B" and away from inlet valve seat 38. This initially opens or allows a further increased flow in a flow passage between inlet flow passage 58 and outlet flow passage 34 to allow pressurized fluid to exit proportional pressure controller 10 at outlet port 30, defining a controller open condition wherein fluid from inlet flow passage 58 is discharged through outlet port 30 (with no flow through exhaust port 32). This operation will be more fully explained in reference to FIG. 4. Proportional pressure controller 10 can initiate flow of pressurized fluid between inlet port 28 and outlet port 30 if no flow is present at outlet port 30, or proportional pressure controller 10 can maintain, increase, or decrease the pressure of an existing flow of the pressurized fluid between inlet port 28 and outlet port 30 in those situations where a continuous regulated flow of pressurized fluid is required.

A portion of the pressurized fluid discharged through fill valve 54 through valve discharge passage 64 is directed via an exhaust valve pressurization passage 72 created in a connecting wall 74 of central body portion 22 into an exhaust valve pressurization chamber 76. When fill valve 54 is open and dump valve 56 is closed the pressurized air or fluid received in exhaust valve pressurization chamber 76 via exhaust valve pressurization passage 72 acts against an exhaust valve end face 78 of an exhaust poppet valve 80 to retain exhaust poppet valve 80 in a seated position shown.

Exhaust poppet valve 80 includes an exhaust poppet valve seat ring 83 which contacts an exhaust valve seat 84 in the seated position of exhaust poppet valve 80. When exhaust poppet valve 80 is in the seated position shown in FIG. 3, pressurized fluid flowing from outlet flow passage 34 through outlet port 30 which also enters an exhaust/outlet common passage 86 is isolated from exhaust port 32 to prevent pressurized flow out of exhaust port 32 through an exhaust flow passage 88.

Exhaust poppet valve 80 includes an integrally connected, axially extending exhaust valve stem 90 which is slidingly received in a stem receiving passage 92 of a stem receiving member 94. Stem receiving member 94 is positioned between a second boundary wall 96 and the first end cap 14. Similar to first boundary wall 45, pressurized fluid can free-flow through second boundary wall 96 via at least one hole 97. A size and quantity of the hole(s) 97 controls the speed at which pressure balances across second boundary wall 96. A dump valve passage 98 is provided at a discharge side of dump valve 56 which communicates via a dump valve exhaust port 100 of central body portion 22 with exhaust flow passage 88. It is noted that dump valve outlet passage 98 is isolated from and therefore does not provide fluid communication with exhaust valve pressurization passage 72, valve discharge passage 64, or piston pressurization passage 66.

It is further noted that each of the valve discharge passage 64, piston pressurization passage 66, exhaust valve pressurization passage 72, and dump valve passage 98 are isolated from fluid pressure in outlet flow passage 34 or exhaust/outlet common passage 86 when fill valve 54 is open. These flow passages therefore allow communication of the filtered air or fluid from inlet port 28 to be communicated through either fill or dump valve 54, 56 without exposing the fill or dump valves 54, 56 to potentially contaminated fluid in outlet port 30.

Proportional pressure controller 10 can further include a circuit board 101 positioned within controller operator 20 which is in electrical communication with both fill and dump valves 54, 56. Signals received at circuit board 101 for positioning control of either fill or dump valve 54, 56 are received via a wiring harness 102 in controller operator 20 which is sealed using a connecting plug 104. A remotely positioned control system 106 performs calculation functions and forwards command signals to circuit board 101 which controls either/both fill and/or dump valves 54, 56 to control a system pressure at outlet port 30. Control signals from and to proportional pressure controller 10 and control system 106 are communicated using a control signal interface 108. Control signal interface 108 can be a hard wire (e.g.: wiring harness) connection, a wireless (e.g.: radio frequency or infra red) connection, or the like. The controller closed condition shown in FIG. 3 for proportional pressure controller 10 is provided when both fill and dump valves 54, 56 are closed having inlet poppet valve 36 seated against inlet valve seat 38, and exhaust poppet valve 80 seated against exhaust valve seat 84.

Figure 4:
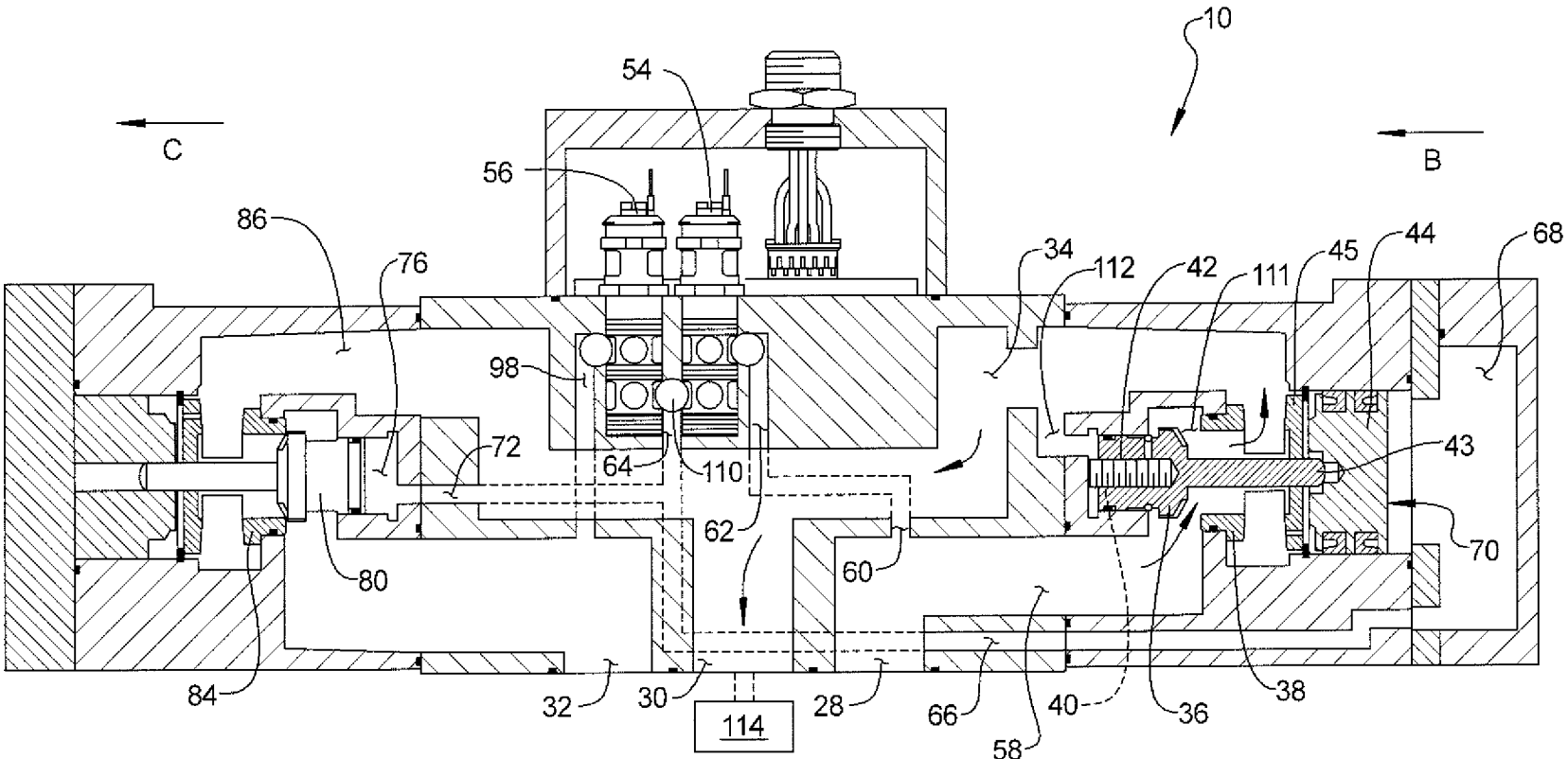
FIG. 4 is a cross sectional front elevational view similar to FIG. 3 showing the proportional pressure controller inlet poppet valve in an open position.

The configuration shown in FIG. 3 is not limiting. For example, although the inlet poppet valve 36 and exhaust valve poppet valve 80 are shown in an opposed configuration, these poppet valves can be arranged in any configuration at the discretion of the manufacturer. Alternate configurations can provide the poppet valves in a side-by-side parallel disposition. The poppet valves can also be oriented such that both poppet valves seat in a same axial direction and unseat in the same opposed axial direction. The configuration shown in FIG. 3 is therefore exemplary of one possible configuration. The configuration shown in FIG. 3 indicates either a closed configuration, with no inlet pressure in communication with outlet port 30, or a pressure achieved condition which occurs when a desired pressure at outlet port 30 is reached but further flow is at least temporarily not required through outlet port 30. FIG. 4 can also depict the pressure achieved condition, occurring when a steady state flow of fluid at a desired pressure is achieved through outlet port 30. The pressure achieved condition can occur at any position of inlet poppet valve 36 with respect to inlet valve seat 38 between and including a seated and a fully open position.

Referring to FIG. 4, the controller open condition or pressurizing configuration of proportional pressure controller 10 is shown. In the open condition, a signal is received to open fill valve 54, with dump valve 56 being retained in a closed position. When fill valve 54 opens, a portion of the air or fluid in inlet port 28 flows through fill valve 54 via the pilot air supply port 60 and the fill inlet passage 62. This airflow exits fill valve 54 into valve discharge passage 64. The pressure of the fluid in valve discharge passage 64 is sensed by a pressure sensor such as a first pressure signaling device 110, which according to several embodiments can be a pressure transducer. The pressurized fluid in valve discharge passage 64 is directed in part through piston pressurization passage 66 into piston pressurization chamber 68 to force piston 44 to slide in the inlet valve opening direction "B" which acts against inlet valve stem 43 to push inlet poppet valve 36 away from inlet valve seat 38, compressing biasing member 40. This opening motion of inlet poppet valve 36 creates an inlet flow ring 111 allowing pressurized fluid in inlet flow passage 58 to flow via inlet flow ring 111 into outlet flow passage 34 and from there as shown by the various flow arrows out of proportional pressure controller 10 through outlet port 30. A first orifice 112 can be provided to permit fluid on the valve cavity 42 side of inlet poppet valve 36 to displace into the outlet flow passage 34 at a controlled rate permitting the sliding speed and therefore the opening timing of inlet poppet valve 36 to be predetermined. Pressurized fluid which exits outlet port 30 can be directed to a pressure actuated device 114 such as a piston operator or similar actuating device. First orifice 112 also allows pressure that is in outlet flow passage 34 to act on the spring side of poppet valve 36 creating additional biasing force toward the closed position.

First boundary wall 45 can also function as a contact surface stopping the sliding motion of piston 44 in the inlet valve opening direction "B". A length of time that inlet poppet valve 36 is in the open position can be used together with the pressure sensed by first pressure signaling device 110 to proportionally control the pressure at pressure actuating device 114. Because first pressure signaling device 110 is also positioned within valve discharge passage 64, first pressure signaling device 110 is also isolated form potential contaminants that may be present in outlet port 30. This reduces the possibility of contaminants affecting the pressure signal of first pressure signaling device 110. As previously noted, when pressurized fluid is being discharged through outlet port 30 and when fill valve 54 is in the open position, pressurized fluid from valve discharge passage 64 is received via exhaust valve pressurization passage 72 in exhaust valve pressurization chamber 76 to retain the exhaust poppet valve 80 in its seated position by forcing the exhaust poppet valve 80 in the exhaust valve closing direction "C".

Figure 5:
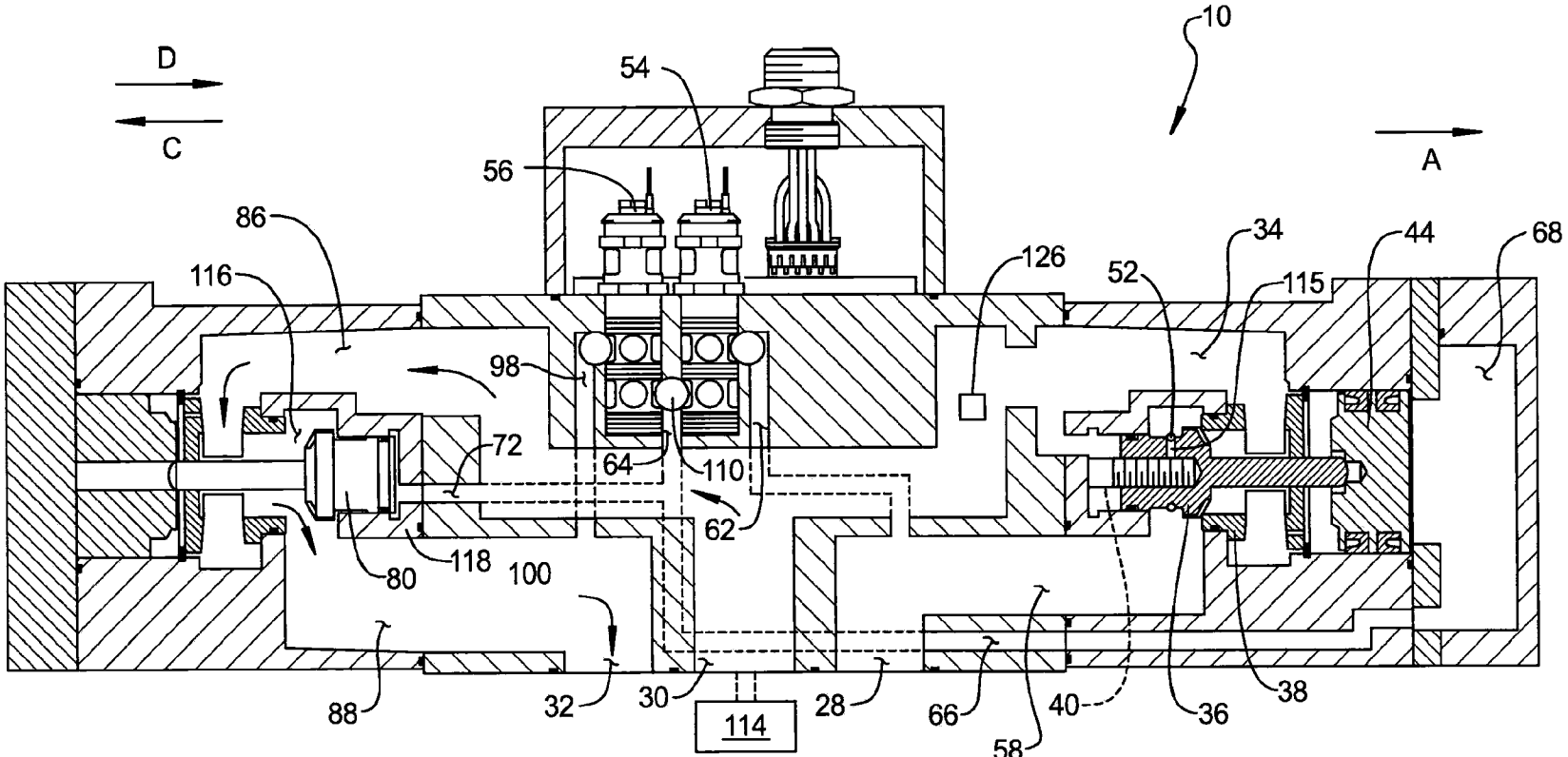
FIG. 5 is across sectional front elevational view similar to FIG. 3 showing the proportional pressure controller exhaust poppet valve in a open position.

Referring to FIG. 5, when a desired pressure is reached at pressure actuated device 114 as sensed by first pressure signaling device 110, fill valve 54 is directed to close and dump valve 56 can be directed to open. Dump valve 56 will also open if the pressure reaches a predetermined (high) pressure or the command signal is given to lower the pressure. When fill valve 54 is in the closed position, pressurized fluid in the fill inlet passage 62 is isolated from the valve discharge passage 64. When dump valve 56 opens, exhaust valve pressurization passage 72 vents to exhaust flow passage 88 via valve discharge passage 64 and dump valve outlet passage 98. The residual fluid pressure at outlet port 30 and exhaust/outlet common passage 86 therefore exceeds the pressure in exhaust valve pressurization passage 72, forcing exhaust poppet valve 80 to translate in the exhaust valve opening direction "D". At this same time, pressurized air or fluid in piston pressurization passage 66 also vents to exhaust flow passage 88 via valve discharge passage 64 and dump valve outlet passage 98. This un-balances the forces acting on inlet poppet valve 36 from piston 44 such that the biasing force of biasing member 40 plus the fluid pressure in outlet flow passage 34 combine to return inlet poppet valve 36 in the inlet valve closing direction "A" to seat inlet poppet valve 36 against inlet valve seat 38. The at least one hole 47 provided through first boundary wall 45 permits fluid pressure equalization across first boundary wall 45 increasing the sliding speed of piston 44 when inlet poppet valve 36 closes. Inlet poppet valve 36 can also be in the closed condition if the desired pressure at outlet port 30 is reached and is static.

As exhaust poppet valve 80 moves in the exhaust valve opening direction "D", an exhaust flow ring 116 opens to allow flow in the direction of the multiple flow arrows shown from exhaust/outlet common passage 86 through exhaust flow ring 116, into exhaust flow passage 88, and exiting via exhaust port 32. The signal to open dump valve 56 is also received when the pressure at pressure actuated device 114 exceeds the desired pressure setting. When the desired pressured setting is exceeded, it is advantageous to exhaust the higher fluid pressure via the exhaust port 32 as rapidly as possible. Pressured balanced exhaust poppet valve 80 is therefore opened which allows rapid de-pressurization via exhaust/outlet common passage 86, exhaust flow ring 116, exhaust flow passage 88, and exhaust port 32. With dump valve 56 open, the dump valve outlet passage 98, depressurizing valve discharge passage 64, piston pressurization passage 66, piston pressurization chamber 68, and exhaust valve pressurization passage 72 also depressurize via exhaust port 32.

Referring to both FIGS. 5 and 3, when dump valve 56 receives a signal to close as the pressure at valve discharge passage 64 sensed by first pressure signaling device 110 reaches the desired pressure, the exhaust poppet valve 80 will remain in the open position until pressure at valve pressurization chamber 76 exceeds pressure in exhaust/outlet common passage 86. Fluid pressure in exhaust valve pressurization passage 72 forces exhaust poppet valve 80 in the exhaust valve closed direction "C" against exhaust valve seat 84 until pressure in exhaust/outlet common passage 86 exceeds the pressure at valve pressurization chamber 76.

Figure 6:
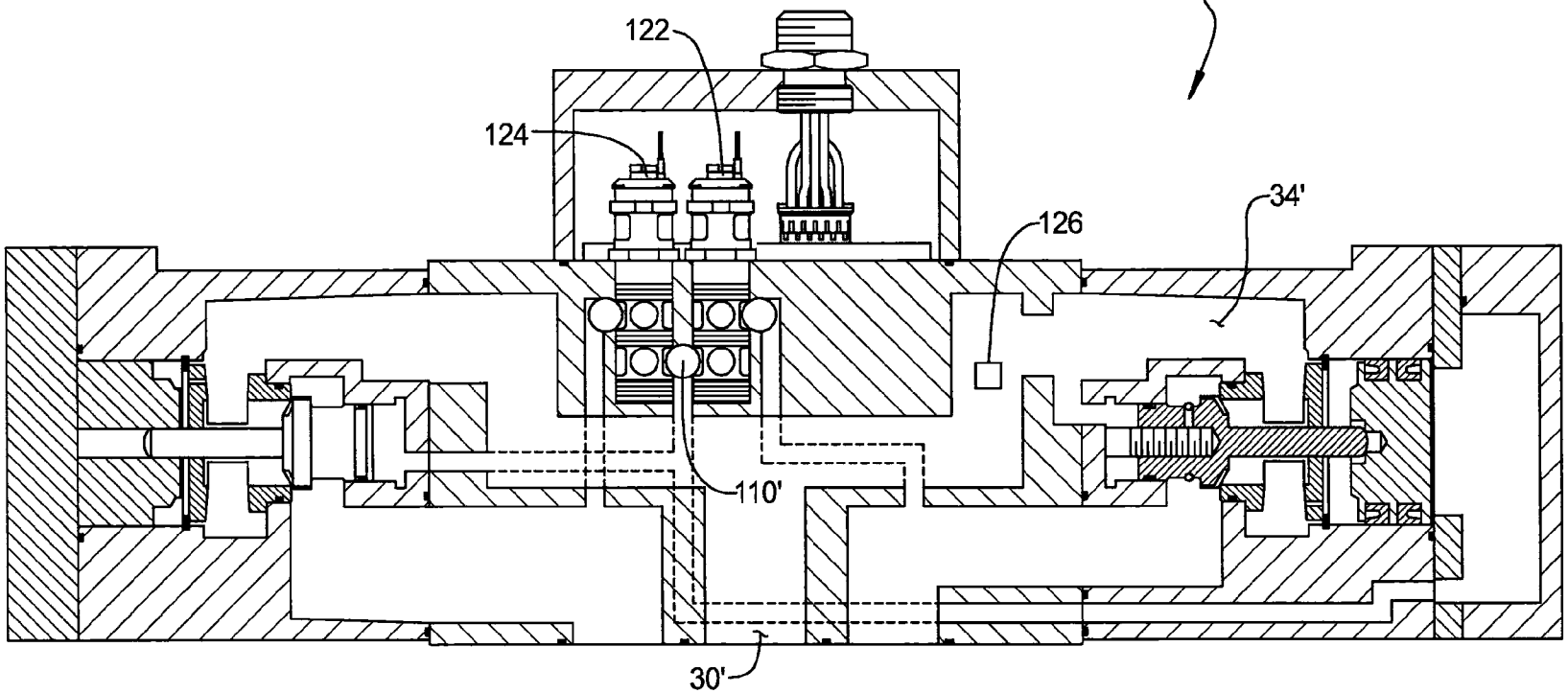
FIG. 6 is a cross sectional front elevational view similar to FIG. 3 of another embodiment of a proportional pressure controller of the present disclosure.

Referring to FIG. 6, according to further embodiments a proportional pressure controller 120 is modified from proportional pressure controller 10 to provide a different type of fill valve 122 and dump valve 124. For example, fill valve 122 and dump valve 124 can be hydraulically operated, solenoid operated, or air operated valves which can provide different operating characteristics for proportional pressure controller 120. Proportional pressure controller 120 can further include a second pressure sensor such as a second pressure signaling device 126 such as a pressure transducer positioned in outlet flow passage 34'. The addition of second pressure signaling device 126 can provide an additional/heightened sensitivity pressure detection signal at outlet port 30'. Using the output or pressure signals received from both first pressure signaling device 110 and second pressure signaling device 126 can provide for finer position and/or open/close timing control of the valve members of proportional pressure controller 120 to mitigate either failing to reach or exceeding the desired pressure at outlet port 30'. The remaining components of proportional pressure controller 120 are substantially the same as those described with reference to proportional pressure controller 10 of FIG. 3. Failing to achieve the desired pressure at the outlet port of known proportional pressure control devices can result in rapid opening/closing operation of the control valves, known as "motor boating", as the controller attempts to correct to the desired pressure by moving solenoid operated valves in response to a pressure signal. The use of first and second pressure signaling devices 110', 126 can provide a differential pressure between the inlet pressure sensed by first pressure signaling device 110', and the pressure at outlet port 30' which is sensed by second pressure signaling device 126, which together provide a real time difference between the desired outlet pressure and the pilot pressure. Together with the fast acting poppet valves (which respond to pressure differences and do not require a control signal) proportional pressure controller 120 can help mitigate the chance of motor boating.

Figure 7:
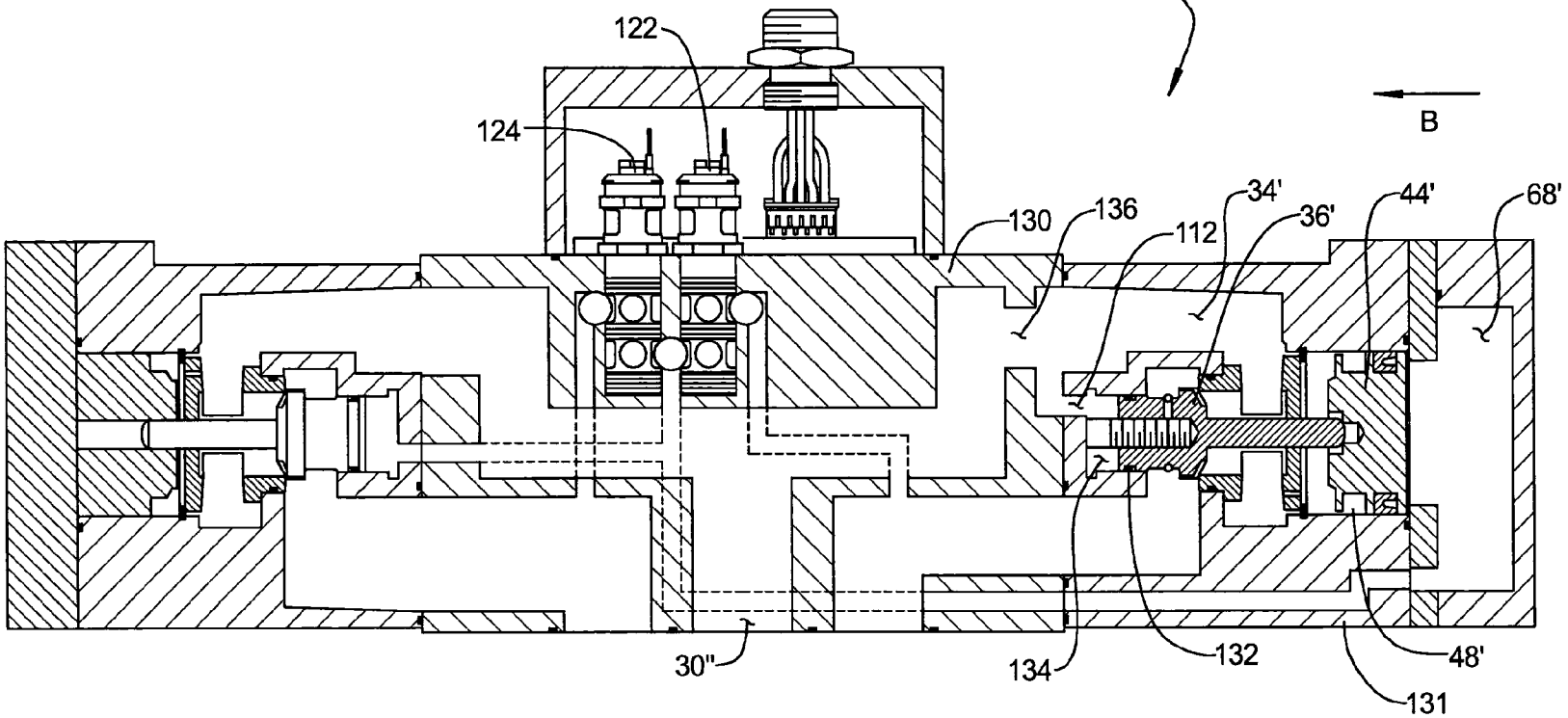
FIG. 7 is a cross sectional front elevational view similar to FIG. 3 of another embodiment of a proportional pressure controller of the present disclosure.

Referring to FIG. 7 and again to FIG. 3, according to other embodiments a proportional pressure controller 128 can include a central body portion 130 which is modified from central body portion 22, and can include an inlet body portion 131 which is modified from the inlet body portion 24 shown in FIG. 3. Inlet poppet valve 36' is provided with a U-cup seal member 132 and is slidably disposed in an inlet poppet valve pressure chamber 134. Pressurized fluid which exits inlet poppet valve pressure chamber 134 as inlet poppet valve 36' moves in inlet valve opening direction "B" is discharged via a first orifice 112' which can be modified at the discretion of the manufacturer to change the flow characteristics of the fluid exiting from inlet poppet valve pressure chamber 134 thereby affecting the operating speed of inlet poppet valve 36'. An outlet flow passage orifice 136 created in central body portion 130 can further be used to control the fluid flow rate from outlet flow passage 34' to outlet port 30". The combination of first orifice 112' and outlet flow passage orifice 136 can be used to increase or decrease the flow rate of pressurized fluid via outlet port 30". Also, by selecting the type of valve used for fill valve 122 and dump valve 124 in proportional pressure controller 128, a valve type that is less susceptible to operating problems from the contaminates present in outlet port 30" can reduce the need for a second U-cup seal in piston 44' such that only single U-cup seal 48' can be used. This can further reduce friction associated with the sliding motion of piston 44' to further enhance the operating speed of inlet poppet valve 36'.

Figure 8:
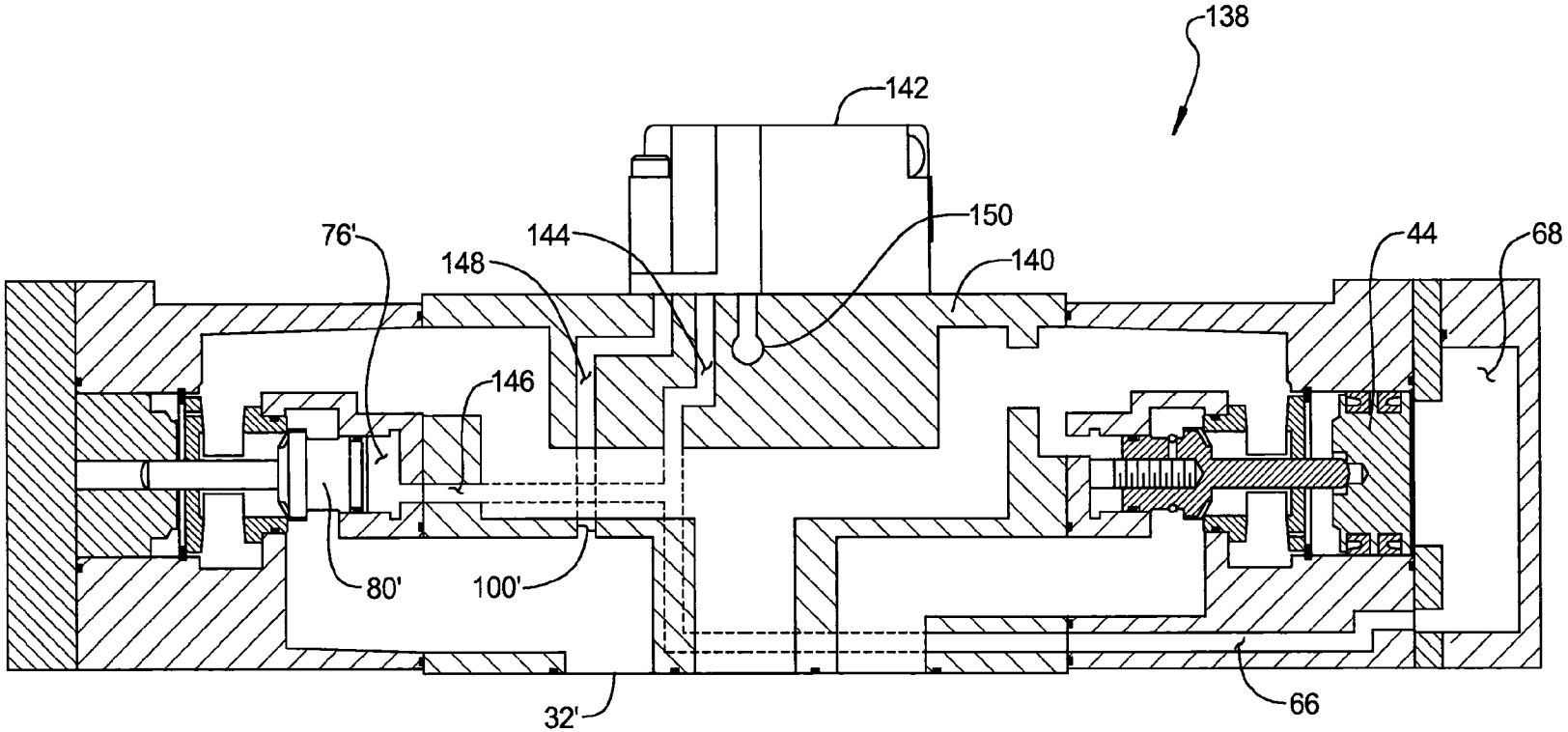
FIG. 8 is a cross sectional front elevational view similar to FIG. 3 of another embodiment of a proportional pressure controller of the present disclosure.

Referring to FIG. 8 and again to FIG. 3, according to still further embodiments a proportional pressure controller 138 can include a central body portion 140 modified with respect to the central body portion. Proportional pressure controller 138 can include a 3-way valve 142 used in place of the fill and dump valves of the previous embodiments. A pilot air outlet passage 144 communicating through 3-way valve 142 can similarly direct pressurized fluid via piston pressurization passage 66' to piston pressurization chamber 68 and piston 44. Pressurized fluid from pilot air outlet passage 144 can also be directed via an exhaust valve pressurization passage 146 into exhaust valve pressurization chamber 76' to fully seat exhaust poppet valve 80'. A separate dump pressure passage 148 communicating with 3-way valve 142 can also vent pressurized fluid via dump valve exhaust port 100' to exhaust port 32'. A pilot air or fluid inlet passage 150 can be created in central body portion 140 to eliminate the need for a separate internal passage providing pilot air to 3-way valve 142. Operation of proportional pressure controller 138 is otherwise similar to the previously described proportional pressure controllers herein.

Figure 9:
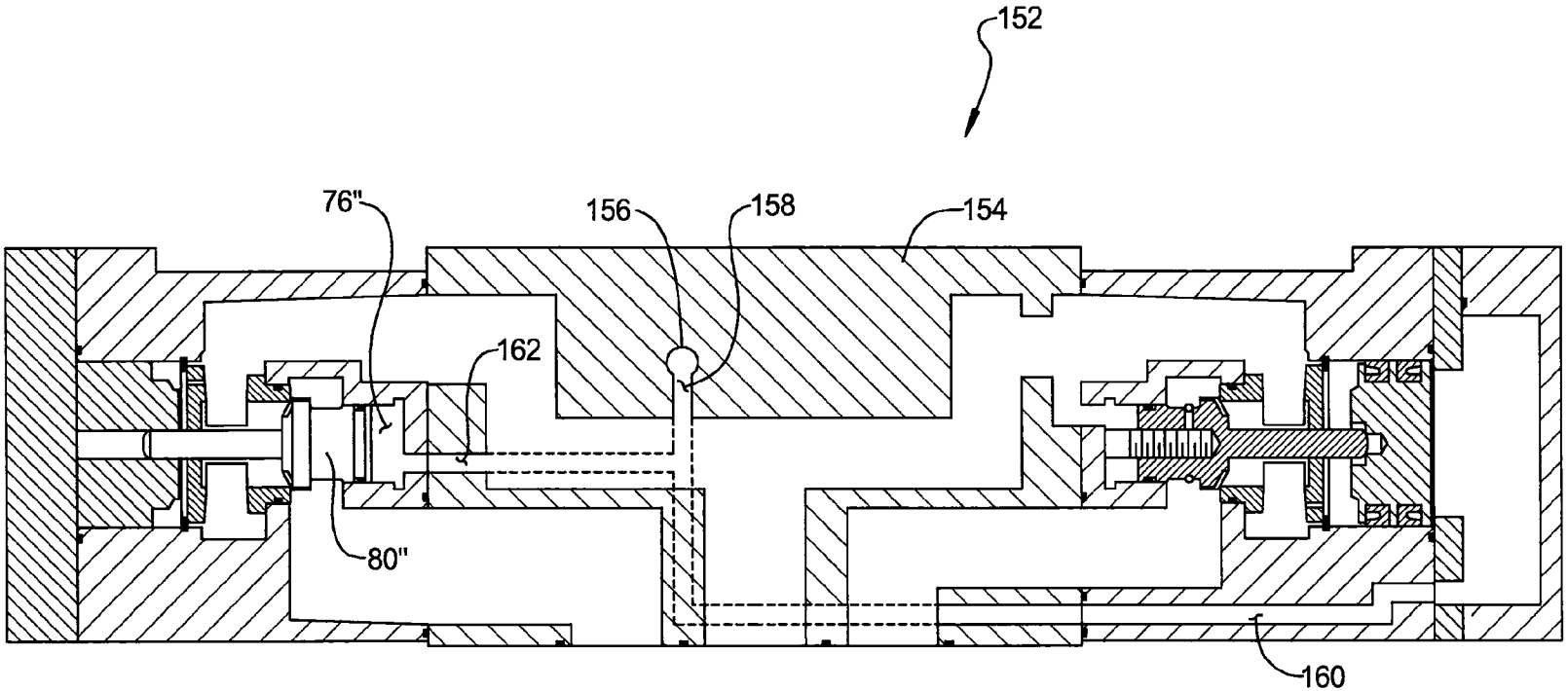
FIG. 9 is a cross sectional front elevational view similar to FIG. 3 of another embodiment of a proportional pressure controller of the present disclosure.

Referring to FIG. 9 and again to FIGS. 3 and 6-8, operating valves such as the fill and dump valves or 3-way valves previously described for the other embodiments of proportional pressure controllers of the present disclosure can be eliminated by the design shown for a proportional pressure controller 152. Proportional pressure controller 152 includes a central body portion 154 also modified from the central body portion 22 shown and described in reference to FIG. 3 to include only a pilot air receiving passage 156 which communicates via a pilot air outlet passage 158 to both a piston pressurization passage 160 and an exhaust poppet pressurization passage 162. Proportional pressure controller 152 eliminates all controller mounted actuating valves and retains only the poppet valves of the previously discussed designs. This permits the space envelope of proportional pressure controller 152 to be minimized and provides for complete remote control of proportional pressure controller 152.

Figure 10:
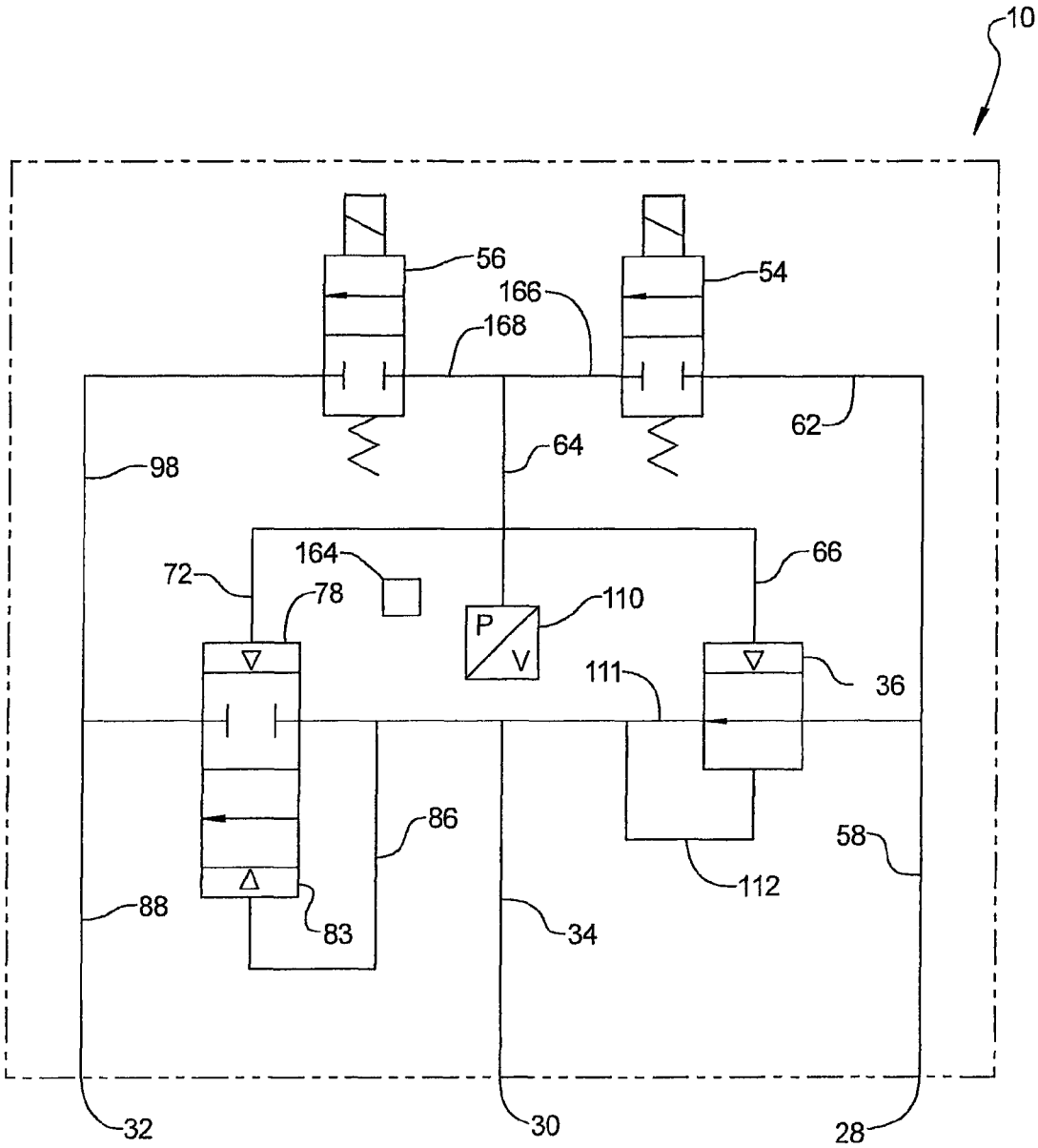
FIG. 10 is a diagrammatic representation of the proportional pressure controller of FIG. 1.

Referring to FIG. 10, proportional pressure controller 10 can provide the first pressure signaling device 110 within the valve discharge outlet passage 64 to isolate the first pressure signaling device 110 from contaminated fluid in the outlet flow passage 34, which helps mitigate against contamination effecting the pressure signal 164 or the timing of generation of the pressure signal 164. A signal to open fill valve 54 provides flow of pressurized fluid in fill inlet passage 62 to the inlet poppet valve 36 via piston pressurization passage 66, and also provides flow of pressurized fluid to exhaust valve end face 78 of exhaust poppet valve 80 via exhaust valve pressurization passage 72. Pressurized fluid discharged from fill valve 56 immediately discharges through a fill valve discharge port 166 which communicates with both valve discharge outlet passage 64 and a dump valve inlet port 168. Pressurized fluid at dump valve inlet port 168 can be blocked by the dump valve 56 from entering dump valve outlet passage 98 and discharging via exhaust port 32 unless dump valve 56 is closed.

Proportional pressure controllers of the present disclosure offer several advantages. By eliminating solenoid actuators associated with the main flow valves of the controller and replacing the valves with poppet valves, small and lower energy consumption pilot valves in the form of fill and dump valves are used to provide pressure actuation to open or close the poppet valves. This reduces the cost and operating power required for the controller. The use of passageways created in the body of the controller to transfer pressurized fluid to actuate the poppet valves which are isolated from the main poppet valve flow paths prevents potentially contaminated fluid at the outlet of the controller from back-flowing into the pilot valves, which could inhibit their operation. One of the passageways can be used to simultaneously provide pressure to open one of the poppet valves while holding the second poppet valve in a closed position. By positioning a pressure sensing device in one of the isolated passageways, the pressure sensing device is also isolated from contaminants to improve the accuracy of the device's pressure signal. Also, the fill and dump valves can be provided in multiple valve forms, including solenoid actuated valves, hydraulically actuated valves, and a 3-way valve replacing both the fill and dump valves.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A proportional pressure controller, comprising:

a controller assembly including:

a body having inlet, outlet, and exhaust ports;

a fill valve in communication with a pressurized fluid in the inlet port;

a dump valve in communication with the pressurized fluid in a discharge passage of the fill valve;

an inlet poppet valve and an exhaust poppet valve;

an outlet flow passage in communication with the pressurized fluid when the inlet poppet valve is moved to an inlet poppet valve open position, the outlet flow passage communicating with the outlet port and an exhaust/outlet common passage normally isolated from the exhaust port when the exhaust poppet valve is in an exhaust poppet valve closed position; and a fill inlet passage providing fluid communication between an inlet flow passage and the fill valve, and isolated from each of the outlet flow passage, the exhaust/outlet common passage, and the outlet and exhaust ports in all operating conditions of the controller, the fill inlet passage communicating with the inlet passage and being continuously pressurized by the pressurized fluid in the inlet passage; and a pressure sensor positioned in the discharge passage to isolate the pressure sensor from fluid in the outlet port.

2. The proportional pressure controller of claim 1, further including a piston in fluid communication with the fill valve and adapted to move the inlet poppet valve from a closed to the inlet poppet valve open position.

3. The proportional pressure controller of claim 2, further including:

a chamber upstream of the piston; and a valve discharge passage in communication with the pressurized fluid from the fill valve providing the pressurized fluid to each of the chamber upstream of the piston and an exhaust valve pressurization chamber, wherein the valve discharge passage is isolated from each of the outlet flow passage, the exhaust/outlet common passage, and the outlet port in all operating conditions of the controller.

4. The proportional pressure controller of claim 1, wherein the inlet poppet valve is slidably disposed in the body and is normally biased to an inlet poppet valve closed position defining a controller closed condition, the inlet poppet valve movable to the inlet poppet valve open position by the pressurized fluid directed through the fill valve resulting from the fill valve opening, defining a controller open condition.

5. The proportional pressure controller of claim 1, wherein the exhaust poppet valve is slidably disposed in the body and is held in the exhaust poppet valve closed position by the fluid pressure directed through the fill valve, the exhaust poppet valve isolating the pressurized fluid from the exhaust port.

6. The proportional pressure controller of claim 1, wherein when the fill valve is closed and the dump valve is open, a dump valve outlet passage in fluid communication with the exhaust port permits the valve discharge passage to depressurize via the exhaust port and permits the exhaust valve to open venting the outlet flow passage and the exhaust/outlet common passage via the exhaust port.

7. A proportional pressure controller, comprising:

a controller body including:

inlet, outlet, and exhaust ports;

an inlet flow passage and an outlet flow passage, the inlet flow passage communicating a flow of pressurized fluid from the inlet port to the outlet flow passage, and the outlet flow passage communicating the flow of pressurized fluid from the inlet flow passage to the outlet port;

a piston slidably disposed in the controller body;

a receiving passage isolated from any of the inlet and outlet flow passages and the inlet, outlet, and exhaust ports in each of an open, a closed, and an exhaust operating condition of the controller, the receiving passage fluidly connecting to a chamber upstream of the piston and to an exhaust valve pressurization chamber;

a slidably disposed inlet poppet valve adapted to isolate the outlet flow passage from the inlet flow passage in an inlet poppet valve closed position, the inlet poppet valve normally biased to the inlet poppet valve closed position;

a slidably disposed exhaust poppet valve normally held in an exhaust poppet valve closed position by the pressurized fluid in the exhaust valve pressurization chamber, the exhaust poppet valve adapted to isolate the outlet flow passage from the exhaust port in the exhaust poppet valve closed position; and a boundary wall positioned between the piston and the inlet poppet valve having at least one aperture permitting fluid flow through the boundary wall.

8. The proportional pressure controller of claim 7, wherein the inlet poppet valve includes:

a valve cavity receiving a biasing member operating to normally bias the inlet poppet valve in an inlet valve closed direction; and a seat ring operating to sealingly contact a valve seat.

9. The proportional pressure controller of claim 7, wherein the inlet poppet valve is movable to an inlet poppet valve open position when the pressurized fluid is directed through the receiving passage to the piston chamber, the pressurized fluid acting on a piston surface area which is larger than an inlet poppet valve surface area creating a force operating to move the piston which pushes the inlet poppet valve to the inlet poppet valve open position.

10. The proportional pressure controller of claim 7, wherein the inlet poppet valve includes a stem extending axially from the inlet poppet valve adapted to contact the piston, wherein pressurization of the piston chamber induces motion of the piston contacting the stem to induce sliding motion of the inlet poppet valve to the inlet poppet valve open position.

11. The proportional pressure controller of claim 7, wherein the body includes:

an inlet body portion having the inlet poppet valve slidably disposed therein;

an exhaust body portion having the exhaust poppet valve slidably disposed therein; and a body portion spatially separating the inlet and outlet body portions.

12. A proportional pressure controller, comprising:

a controller body including:

inlet, outlet, and exhaust ports;

an inlet passage and an outlet passage, the inlet passage communicating a flow of pressurized fluid from the inlet port to the outlet passage, and the outlet passage communicating the flow of pressurized fluid from the inlet passage to the outlet port;

a piston slidably disposed in the controller body;

a receiving passage isolated from any of the inlet and outlet passages and the inlet, outlet, and exhaust ports in each of an open, a closed, and an exhaust operating condition of the controller, the receiving passage fluidly connecting to a chamber upstream of the piston and to an exhaust valve pressurization chamber;

a slidably disposed inlet poppet valve adapted to isolate the outlet passage from the inlet passage in an inlet poppet valve closed position, the inlet poppet valve normally biased to the inlet poppet valve closed position; and a slidably disposed exhaust poppet valve normally held in an exhaust poppet valve closed position by the pressurized fluid in the exhaust valve pressurization chamber, the exhaust poppet valve adapted to isolate outlet passage from the exhaust port in the exhaust poppet valve closed position;

wherein the inlet poppet valve is slidably disposed in a pressure chamber, the pressure chamber in fluid communication with the outlet flow passage via an orifice sized to control an operating speed of the inlet poppet valve.

13. A proportional pressure controller, comprising:

a controller assembly having open, closed/pressure achieved, and exhaust controller positions, the controller assembly including:

a body having inlet, outlet, and exhaust ports and an exhaust/outlet common passage;

a fill valve in communication with a pressurized fluid in the inlet port;

a dump valve in communication with the pressurized fluid in a discharge passage of the fill valve;

a piston slidably disposed in the body in communication with a piston pressurization chamber and moved in response to the pressurized fluid entering the piston pressurization chamber;

an inlet poppet valve contacting the piston and slidably disposed in the body, the inlet poppet valve normally biased to an inlet poppet valve closed position in the closed controller position, the inlet poppet valve movable by displacement of the piston to an inlet poppet valve open position defining the open controller position; and an exhaust poppet valve slidably disposed in the body and held in an exhaust poppet valve closed position by the fluid pressure directed through the fill valve acting on an end face of the exhaust poppet valve, the fluid pressure creating a greater force than a force due to pressure in the exhaust/outlet common passage of the body acting on an opposite face of the exhaust poppet valve, the exhaust poppet valve isolating the pressurized fluid from the exhaust port when in the closed position.

14. The proportional pressure controller of claim 13, wherein the body further includes an outlet flow passage in communication with the pressurized fluid when the inlet poppet valve is moved to the inlet poppet valve open position, the outlet flow passage communicating with the outlet port and the exhaust/outlet common passage normally isolated from the exhaust port when the exhaust poppet valve is in the exhaust poppet valve closed position.

15. The proportional pressure controller of claim 14, wherein the body further includes a fill inlet passage providing fluid communication between an inlet flow passage and the fill valve, and isolated from each of the outlet flow passage, the exhaust/outlet common passage, and the outlet and exhaust ports in all operating positions of the controller, the fill inlet passage communicating with the inlet flow passage and being continuously pressurized by the pressurized fluid in the inlet flow passage.

16. The proportional pressure controller of claim 13, wherein the controller assembly includes inlet, exhaust, and common body portions, the inlet and exhaust body portions being releasably and sealingly connected to the common body portion.

17. The proportional pressure controller of claim 16, wherein the inlet, outlet, and exhaust ports are created in the common body portion.

18. The proportional pressure controller of claim 16, wherein the common body portion receives the inlet poppet valve and the exhaust poppet valve.

19. The proportional pressure controller of claim 16, wherein the inlet poppet valve is slidably disposed in the inlet body portion.

20. The proportional pressure controller of claim 16, wherein the exhaust poppet valve is slidably disposed in the exhaust body portion.

21. The proportional pressure controller of claim 16, wherein both the inlet poppet valve and the piston are slidably disposed in the inlet body portion.

22. The proportional pressure controller of claim 13, further including a pressure sensor positioned in a discharge passage exiting from the fill valve to isolate the pressure sensor from a fluid in the outlet port.

23. The proportional pressure controller of claim 13, further including:

the piston pressurization chamber located upstream of the piston; and a valve discharge passage communicating the pressurized fluid from the fill valve to the dump valve, and simultaneously providing fluid communication of the pressurized fluid to each of the piston pressurization chamber upstream of the piston and an exhaust valve pressurization chamber, wherein the valve discharge passage is isolated from each of the outlet flow passage, the exhaust/outlet common passage, and the outlet port in all operating positions of the controller.

24. A proportional pressure controller, comprising:

a controller assembly having open, closed/pressure achieved, and exhaust controller conditions, the controller assembly including:

a body having inlet, outlet, and exhaust ports, and an exhaust/outlet common passage;

a valve system adapted to control flow of a pressurized fluid;

an inlet poppet valve slidably disposed in the body and normally biased to an inlet poppet valve closed position defining the controller closed/pressure achieved condition, the inlet poppet valve movable to an inlet poppet valve open position defining the controller open condition by the pressurized fluid directed through the valve system;

an exhaust poppet valve slidably disposed in the body and held in an exhaust poppet valve closed position by pressurized fluid directed through the valve system into an exhaust valve pressurization chamber;

an outlet flow passage in communication with the pressurized fluid from the inlet port when the inlet poppet valve is moved to the inlet poppet valve open position, the outlet flow passage communicating with the outlet port and the exhaust/outlet common passage normally isolated from the exhaust port when the exhaust poppet valve is in the exhaust poppet valve closed position; and a fill inlet passage providing fluid communication between an inlet flow passage and the valve system, the fill inlet passage isolated from each of the outlet flow passage, the exhaust/outlet common passage, and the outlet and exhaust ports in all the operating conditions of the controller, the fill inlet passage communicating with and being continuously pressurized by the pressurized fluid in the inlet flow passage.

25. The proportional pressure controller of claim 24, wherein the valve system includes:

a piston including an end face, the piston slidably disposed in the body in communication with a piston pressurization chamber and moved in response to the pressurized fluid entering the piston pressurization chamber; and a fill valve in communication with the fill inlet passage operating to isolate the pressurized fluid from the inlet and exhaust poppet valves when the fill valve is in a closed position, and opened to permit flow of the pressurized fluid to act upon the piston end face and an exhaust valve end face.

26. The proportional pressure controller of claim 25, wherein the valve system includes a dump valve which when opened decreases a pressure of the pressurized fluid acting upon the piston end face and the exhaust valve end face.

27. The proportional pressure controller of claim 26, wherein the dump valve comprises a solenoid actuated valve.

28. The proportional pressure controller of claim 25, wherein the fill valve comprises a solenoid actuated valve.

29. The proportional pressure controller of claim 25, further including:

a first pressure signaling device positioned in a discharge passage downstream of the fill valve adapted to output a sensed pressure signal; and a control system adapted to receive the sensed pressure signal from the first pressure signaling device and control the valve system.

30. The proportional pressure controller of claim 29, further including a second pressure signaling device positioned in an outlet flow passage from the outlet port adapted to output a second sensed pressure signal received by the control system to refine control of the valve system.

31. The proportional pressure controller of claim 24, wherein the valve system includes a 3-way valve mounted to the valve body and in communication with a fill valve inlet passage.

32. The proportional pressure controller of claim 31, wherein the valve system further includes each of an air operated fill and dump valve, having the fill valve in communication with the fill valve inlet passage.

33. The proportional pressure controller of claim 31, wherein the valve system further includes each of a hydraulically operated fill and dump valve, having the fill valve in communication with the fill valve inlet passage.

* * * * *